United States Patent [19]

Stinemates

[11] Patent Number: 4,754,498

[45] Date of Patent: Jul. 5, 1988

[54] GUN MITTEN

[76] Inventor: James L. Stinemates, 360 Boundary, Middletown, Iowa 52638

[21] Appl. No.: 119,753

[22] Filed: Nov. 10, 1987

[51] Int. Cl.[4] ..... F41C 27/00; A41D 13/18; A41D 19/00

[52] U.S. Cl. ..... 2/17; 2/158; 2/161 A; 42/96; 42/106

[58] Field of Search ..... 2/17, 158, 159, 160, 2/161 A; 42/96, 106

[56] References Cited

U.S. PATENT DOCUMENTS

| | | | |
|---|---|---|---|
| 1,400,655 | 12/1921 | Boltnert | 2/158 |
| 2,609,543 | 9/1952 | Farrell | 2/158 |
| 2,941,214 | 6/1960 | Michael | 2/158 X |
| 2,997,042 | 8/1961 | Mitchell | 42/106 X |
| 3,116,502 | 1/1964 | Gerber | 2/158 X |
| 3,701,371 | 10/1972 | Stackhouse | 42/96 X |
| 4,213,205 | 7/1980 | Smith | 2/161 A |
| 4,433,500 | 2/1984 | Kunevicius | 42/96 |
| 4,488,313 | 12/1984 | Delaney | 2/17 |
| 4,698,851 | 10/1987 | Dunford | 2/161 A |
| 4,727,675 | 3/1988 | Huntt | 2/161 A |

*Primary Examiner*—Louis K. Rimrodt

*Attorney, Agent, or Firm*—Henderson & Sturm

[57] ABSTRACT

The gun mitten is intended for use with a long gun (shotgun, rifle, etc.,) and comprises a body formed of flexible material such as synthetic fabric or the like which may be quilted or otherwise enhanced with insulating material to provide a substantially weatherproof enclosure for the stock, grip, trigger and trigger guard area of the gun while also enclosing the shooter's hand and forearm. The body is a bifurcated unit made up of a pair of angularly related sleeves, one for the gun stock, etc. and the other for the shooter's hand and forearm. The sleeves meet at a junction in the area of the trigger and this junction opens to the insulated chamber or pocket formed in the trigger area for access of the shooter's hand and fingers to the grip and trigger.

11 Claims, 2 Drawing Sheets

GUN MITTEN

BACKGROUND AND SUMMARY OF THE INVENTION

Although the prior art contains several examples of covers and the like for long guns, none appear to be directed to more than simply covering the gun or parts thereof as a means of protection during storage, carrying, etc. The present invention departs from the area of simple gun covers and provides an accessory for use by the shooter (hunter, etc.) during firing of the gun, whether for hunting, practice or the like. The accessory is an insulated body that provides warmth, comfort and convenience for the shooter's hand and forearm by means of a first sleeve that receives the shooter's hand and forearm and opens to a second sleeve that enclosed the stock and trigger area of the gun whereby the shooter's enclosed hand has access to the grip and trigger of the gun. The gun sleeve is preferably elongated so as to cover the stock and to extend forwardly of the trigger guard at about the receiver area where it is provided with means forming a snug fit about the proximate portion of the gun, thereby creating an enclosure or pocket to which the arm sleeve leads. In use the hunter may carry the gun with both sleeves in position and his hand on the grip at the forward part of the stock. The rear part of the part of the arm sleeve fits snugly about the shooter's arm, and the interior of the accessory thus forms a chamber from which there is little if any material heat loss. The material of which the accessory is made by be waterproof or nearly so, further enhancing the utility of the accessory. Further, with the preferred design, the accessory does not interfere with the gun sights, and, still further, may be constructed to fit a wide variety of long guns, including bolt-action types.

The foregoing and additional features of the invention will be seen from the ensuing detailed description and accompanying sheets of drawings.

DETAILED DESCRIPTION OF A PREFERRED EMBODIMENT OF THE INVENTION

Figure 1:
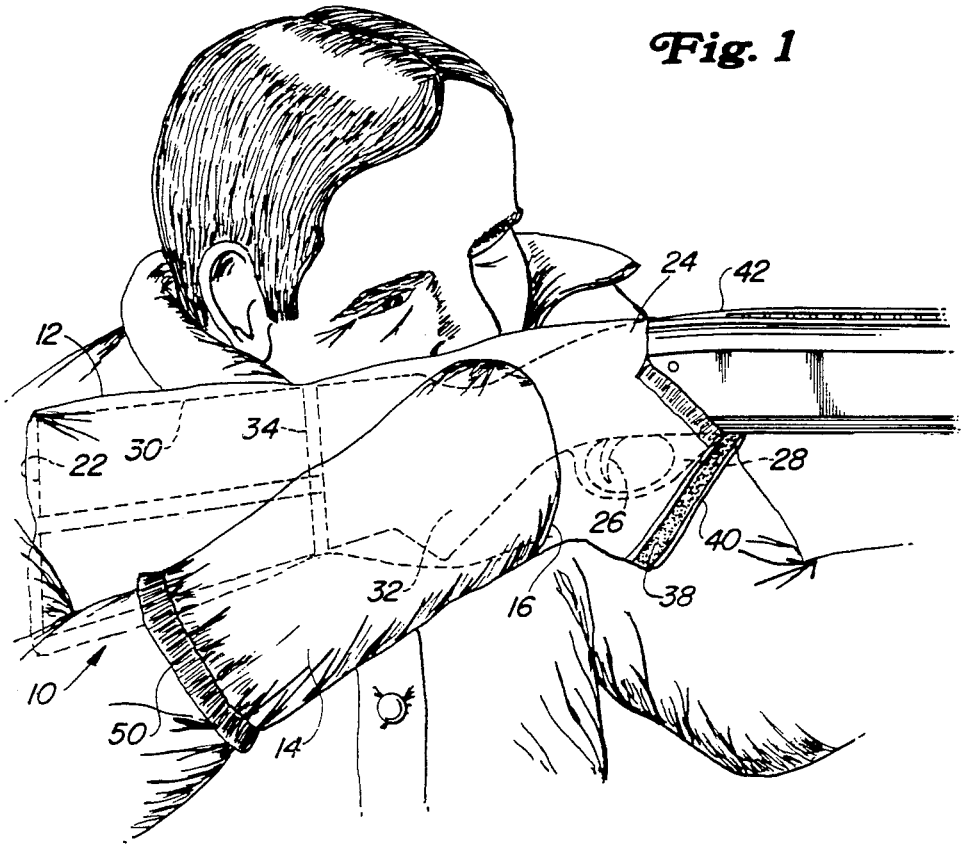
FIG. 1 is a view showing the use of the inventive accessory by a person using a long gun.
Figure 2:
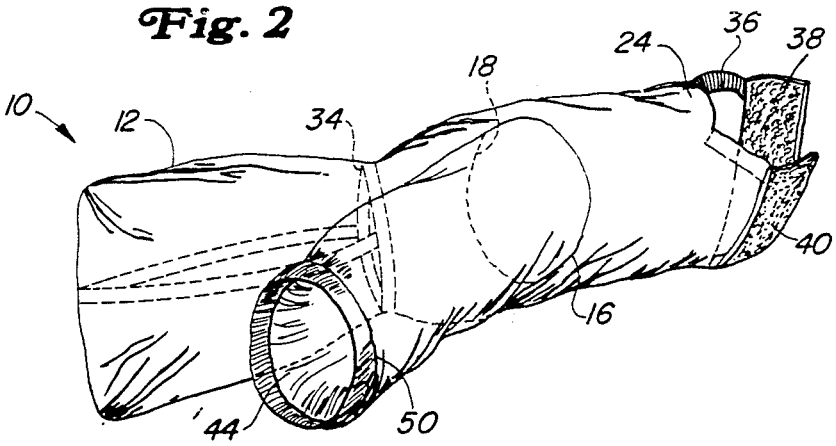
FIG. 2 is a perspective of the accessory by itself.

The accessory or mitten comprises a body 10 that is preferably made of 100 percent each of nylon, acrylic and polyester quilted together for warmth. The body bifurcated to afford first and second or gun and arm sleeves or tubular parts 12 and 14. The sleeves meet at a junction 16 so that an opening 18 is provided whereby the arm sleeve 14 communicates with the gun sleeve in an area in which a chamber or pocket 20 is created, the purpose of which will presently appear.

The gun sleeve is preferably elongated so as to extend from the gun but 22 to a forward portion 24 just ahead of the gun area that forms the situs of each of the trigger 26 and trigger guard 28. The rear end of the sleeve 12 is closed about the butt and the sleeve encloses the stock

Figure 3:
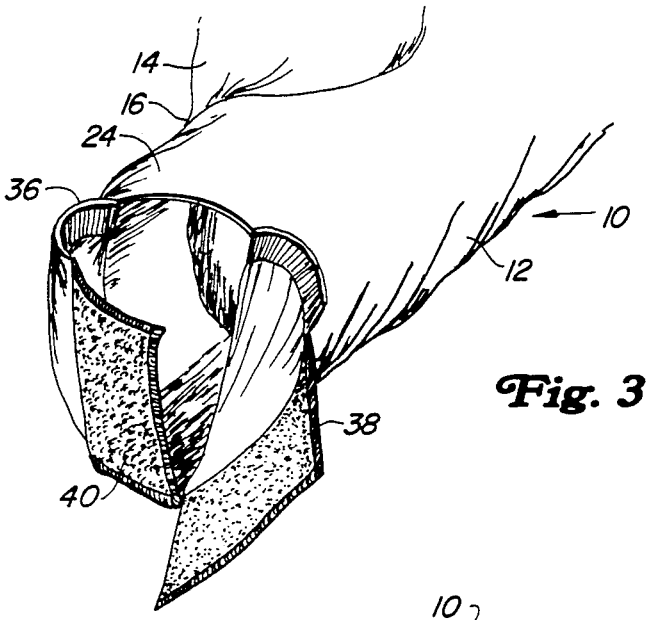
FIG. 3 is a perspective of the open forward portion of the gun sleeve as seen by a person looking rearwardly.
Figure 4:
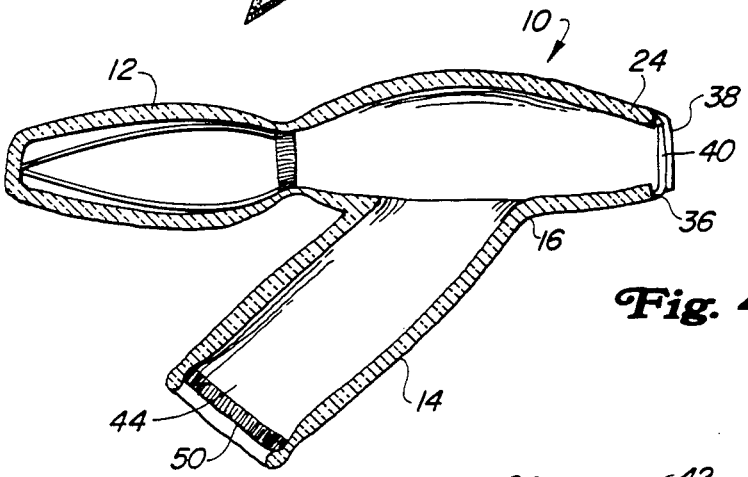
FIG. 4 is a section through both sleeves of the accessory.
Figure 5:
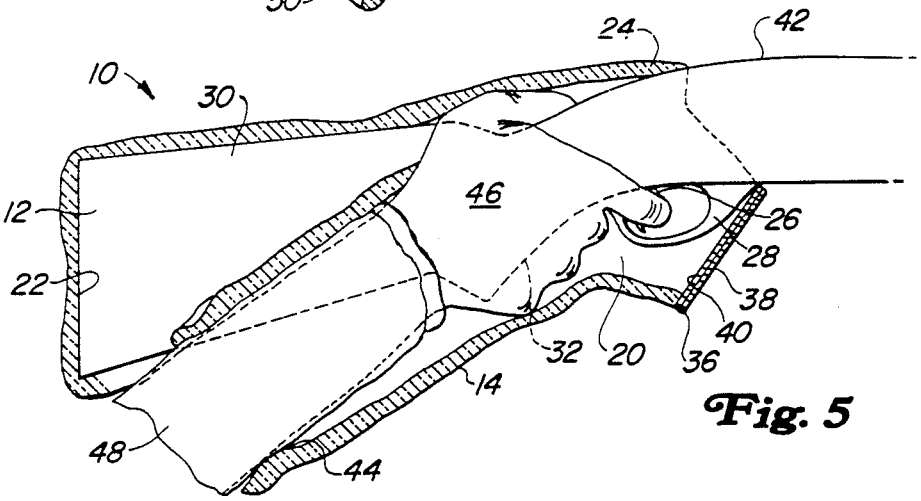
FIG. 5 is section through the arm sleeve and a forward portion of the gun sleeve, showing a portion of the gun and shooter's hand and forearm in elevation.

30 of the gun as well as the trigger and trigger guard and grip 32. The sleeve 12 is provided intermediate its front end with constriction means 34 of any suitable nature; e.g., elastic, etc. which fits the stock snugly and acts as a rear seal rearwardly of the pocket 20. The front part of the gun sleeve has extension means 36 that provides a front opening closeable by means in the form of cooperative flaps 38 and 40. When the flaps are open (FIG. 3), slipping of the gun sleeve forwardly over the gun stock, etc. is facilitated. When the sleeve is in place, the flaps are interconnected to form a snug fit or front seal about that portion of the gun just ahead of the trigger and trigger guard area (FIGS. 1, 4 and 5). The flaps are here shown as being equipped with hook and loop means such as the well-known Velcro; although, and other means may be used to afford the necessary front opening and seal. As will be best seen from FIGS. 1 and 5, the relationship of the front seal is such as to avoid interference with the rear gun sight area 42. The accessory, when intended for use with a bolt-action gun, may be enlarged just rearwardly of the front seal so as to accommodate the bolt and to enable the user to operate the bolt.

As already described, the front end of the arm sleeve 14 shares the opening 18 with the gun sleeve. The rear end of the sleeve 14 has an opening 44 through which the shooter can easily thrust his hand and forearm forwardly until his hand enters the pocket 20 via the junction opening 18, as best depicted in FIG. 5, the shooter's hand appearing at 46 and his forearm at 48. This view further illustrates the shooter's grasp on the gun grip 32 and his forefinger on the trigger. Although this view shows that the shooter has a garment sleeve over his forearm, the accessory may be used with or without upper-body garments and may even be used with a separate lightweight shooter's glove if desired. The rear opening 44 of the sleeve is fitted with constriction means in form of an elasticized sewn-in band 50 that fits snugly about the shooter's forearm.

To use the mitten, it is necessary first to open the front seal flaps 38 and 40 so that the gun sleeve can be slipped forwardly over the stock to the end that the flaps can be snugly interconnected just ahead of the receiver area (trigger and trigger guard, etc.) The shooter then thrusts his arm forwardly into the arm sleeve until his hand enters the pocket 20 via the opening 18 at the junction of the two sleeves. The combination of the sleeves and snug fits are the front and rear of the gun sleeve and at the rear of the arm sleeve assures that the interior of the mitten, and especially the chamber or pocket 20, is virtually weatherproof, at least in the sense of inhibiting heat loss; and, if the body or accessory material is water-resistant, substantially complete weatherproof comfort is afforded. It is preferred that the arm sleeve extend a substantial distance over the user's forearm so as to avoid possible forward creeping of a shorter sleeve; e.g., a wristlet; although, such shorter expedients can be resorted to within the scope of the invention, which observation applies also to the use of a shorter gun sleeve. These and other alterations may be made in exploiting the invention, all without departure from the spirit and scope of the invention.

I claim:

1. A mitten for use with a long gun, comprising a body of flexible, lightweight material made up of a first sleeve shaped and dimensioned to enclose at least that area of the gun including the grip, receiver and trigger and trigger guard, said sleeve having forward extension means configured to fit snugly around the gun just ahead of the trigger guard, and a second sleeve including a forward part having a junction with the first sleeve at approximately the area of the grip of the gun, said second sleeve having a rear opening for receiving the hand and at least the hand-adjoining wrist of a person using the gun, and said forward part of the second sleeve opening to the first sleeve at said junction to provide access of the person's hand and fingers to the grip and trigger of the gun.

2. The mitten according to claim 1, in which the first sleeve includes separable portions enabling removal of the first sleeve from the gun.

3. The mitten according to claim 1, in which the forward extension means of the first sleeve includes separable elements for enabling rearward removal of the first sleeve from the gun.

4. The mitten according to claim 1, in which the second sleeve includes means for snugly constricting at least the rear portion of said sleeve about at least a portion of the person's forearm.

5. The mitten according to claim 1, in which the first sleeve is elongated so as to cover at least the sides, top and bottom of the stock of the gun.

6. The mitten according to claim 5, in which the first sleeve includes a portion for engaging the butt of the stock.

7. The mitten according to claim 6, in which the last-named portion encloses the butt so that the sleeve encloses the stock from the butt to the trigger guard except for the opening at the junction of the two sleeves.

8. The mitten according to claim 7, in which the first sleeve includes means constricting the sleeve about the stock.

9. The mitten according to claim 8, in which the first sleeve includes separable portions enabling removal of the sleeve from the gun.

10. The mitten according to claim 8, in which the forwrad extension means of the first sleeve includes separable elements enabling rearward removal of the sleeve from the gun.

11. The mitten according to claim 1 in which the forward extension means of the first sleeve provides a substantially weatherproof seal about the gun in the area of the trigger guard, and a portion of the first sleeve includes means providing a substantially weatherproof seal about the gun rearwardly of the junction of the second sleeve with the first sleeve.

* * * * *

UNITED STATES PATENT AND TRADEMARK OFFICE

CERTIFICATE OF CORRECTION

PATENT NO. : 4,754,498

DATED : July 5, 1988

INVENTOR(S) : James L. Stinemates

It is certified that error appears in the above-identified patent and that said Letters Patent are hereby corrected as shown below:

Column 1, line 27, "The rear part of the part of the arm sleeve fits snugly about the shooter's arm" should read --The rear part of the stock sleeve fits snugly about the stock and the rear part of the arm sleeve fits snugly about the shooter's arm--.

Signed and Sealed this

Thirteenth Day of December, 1988

*Attest:*

DONALD J. QUIGG

*Attesting Officer*

*Commissioner of Patents and Trademarks*